US009236666B2

(12) United States Patent
Matsushita

(10) Patent No.: US 9,236,666 B2
(45) Date of Patent: Jan. 12, 2016

(54) STRUCTURE OF CONNECTION BETWEEN COAXIAL CABLE AND SHIELD TERMINAL, AND METHOD OF CONNECTION THEREBETWEEN

(71) Applicant: Yazaki Corporation, Tokyo (JP)

(72) Inventor: Kouichiro Matsushita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 150 days.

(21) Appl. No.: 14/204,334

(22) Filed: Mar. 11, 2014

(65) Prior Publication Data

US 2014/0190743 A1 Jul. 10, 2014

Related U.S. Application Data

(63) Continuation of application No. PCT/JP2012/073390, filed on Sep. 6, 2012.

(30) Foreign Application Priority Data

Sep. 12, 2011 (JP) ..... 2011-198136

(51) Int. Cl.
*H01R 4/18* (2006.01)
*H01R 4/20* (2006.01)
(Continued)

(52) U.S. Cl.
CPC ..... *H01R 4/183* (2013.01); *H01R 4/20* (2013.01); *H01R 9/0518* (2013.01); *H01R 43/048* (2013.01)

(58) Field of Classification Search
CPC ..... H01R 4/183; H01R 4/20; H01R 9/0518; H01R 43/048
USPC ..... 174/75 R
See application file for complete search history.

(56) References Cited

U.S. PATENT DOCUMENTS 3,781,762 A * 12/1973 Quackenbush ..... H01R 9/0518 439/322
3,828,305 A * 8/1974 Hogendobler ..... H01R 9/0518 439/585
7,207,839 B1 * 4/2007 Shelly ..... H01R 4/2404 439/585

(Continued)

FOREIGN PATENT DOCUMENTS

CN 2125882 U 12/1993
CN 1801533 A 7/2006

(Continued)

OTHER PUBLICATIONS

ISR (PCT/ISA/210) issued Nov. 20, 2012, in corresponding International Application No. PCT/JP2012/073390.

(Continued)

*Primary Examiner* — Timothy Thompson
*Assistant Examiner* — Charles Pizzuto
(74) *Attorney, Agent, or Firm* — Sughrue Mion, PLLC

(57) ABSTRACT

A structure of connection between a coaxial cable and a shield terminal includes the coaxial cable configured to have at least one core wire part made of a conductor, an insulating coating part with which said core wire part is coated, a braided shield with which an outer peripheral surface of said insulating coating part is covered, and an insulating tube with which an outer peripheral surface of said braided shield is covered, the shield terminal that has a cylindrical press bond part pressed and is bonded to the outer peripheral surface of the braided shield, and a ring-shaped crimp member that is pressed and bonded to an outer peripheral surface of the insulating tube.

3 Claims, 12 Drawing Sheets

(51) Int. Cl.
*H01R 9/05* (2006.01)
*H01R 43/048* (2006.01)

(56) References Cited

U.S. PATENT DOCUMENTS

| | | | | |
|---|---|---|---|---|
| 2005/0054237 | A1* | 3/2005 | Gladd | H02G 15/085 439/578 |
| 2005/0282434 | A1* | 12/2005 | Morikawa | H01R 9/0518 439/578 |
| 2006/0137893 | A1 | 6/2006 | Sumi et al. | |
| 2007/0232088 | A1 | 10/2007 | Burris et al. | |
| 2009/0098769 | A1* | 4/2009 | Sakamoto | H01R 4/184 439/578 |

FOREIGN PATENT DOCUMENTS

| | | | |
|---|---|---|---|
| CN | 101461098 | A | 6/2009 |
| EP | 0902502 | A1 | 3/1999 |
| FR | 2374758 | A1 | 7/1978 |
| JP | 62-100959 | A | 5/1987 |
| JP | 2000-268924 | A | 9/2000 |
| JP | 2009099266 | A | 5/2009 |

OTHER PUBLICATIONS

Written Opinion (PCT/ISA/237) issued Nov. 20, 2012, in corresponding International Application No. PCT/JP2012/073390.

Communication dated May 20, 2015 issued by Japanese Patent Office in counterpart Japanese Application No. 2011-198136.

Office Action issued Jul. 1, 2015, issued by the State Intellectual Property Office of the People's Republic of China in counterpart Chinese Patent Application No. 201280044147.X.

* cited by examiner

STRUCTURE OF CONNECTION BETWEEN COAXIAL CABLE AND SHIELD TERMINAL, AND METHOD OF CONNECTION THEREBETWEEN

CROSS REFERENCE TO RELATED APPLICATIONS

This application is a continuation of PCT application No. PCT/JP2012/073390, which was filed on Sep. 6, 2012 based on Japanese Patent Application (No. 2011-198136) filed on Sep. 12, 2011, the contents of which are incorporated herein by reference.

BACKGROUND OF THE INVENTION

1. Field of the Invention

The present invention relates to a structure of connection between a coaxial cable and a shield terminal, and a method of connection therebetween.

2. Description of the Related Art

A coaxial cable used as an antenna wire etc. is conventionally constructed so that in order to block noise of electromagnetic waves etc. from the outside, a core wire part made of a conductor covered with an insulating coating is covered with a braided shield and an outer peripheral surface of this braided shield is covered with an insulating tube. In such a coaxial cable, a shield terminal is connected to the braided shield in order to make earth connection between the braided shield and an earth part. For example, JP-A-2009-99266 proposes a structure of connection between a coaxial cable and a shield terminal configured to have the coaxial cable and the shield terminal pressed and bonded to a braided shield.

In this structure of connection between the coaxial cable and the shield terminal described in JP-A-2009-99266, the shield terminal has an inside terminal receiving part for receiving an inside terminal connected to a core wire of the coaxial cable, an insertion part which cylindrically extends from one end of the inside terminal receiving part and is inserted between an exposed portion of the braided shield exposed to the distal end of the coaxial cable and an insulating coating with which the core wire is covered, and a press bond part for pressing and bonding the exposed portion so as to pinch the exposed portion between this insertion part and the press bond part.

SUMMARY OF THE INVENTION

In the structure of connection between the coaxial cable and the shield terminal described in JP-A-2009-99266, an insulating tube must be peeled so as to expose the braided shield in the size according to the press bond part of the shield terminal when the shield terminal is pressed and bonded to the braided shield, so that there was a problem that assembly work became complicated.

The invention has been implemented in view of the above, and an object of the invention is to provide a structure of connection between a coaxial cable and a shield terminal capable of facilitating assembly work, and a method of connection therebetween.

(1) According to one aspect of the present invention, a structure of connection between a coaxial cable and a shield terminal includes the coaxial cable configured to have at least one core wire part made of a conductor, an insulating coating part with which said core wire part is coated, a braided shield with which an outer peripheral surface of said insulating coating part is covered, and an insulating tube with which an outer peripheral surface of said braided shield is covered, the shield terminal having a cylindrical press bond part pressed and bonded to the outer peripheral surface of the braided shield, and a ring-shaped crimp member pressed and bonded to an outer peripheral surface of the insulating tube, wherein at least an end of the insulating tube is configured to form a gap between the braided shield and have an inside diameter larger than an outside diameter of the press bond part, the crimp member is arranged on the end of the insulating tube, and the press bond part is inserted between an inner peripheral surface of the end of the insulating tube and the outer peripheral surface of the braided shield and is pressed and bonded to the outer peripheral surface of the braided shield by pressing and bonding the crimp member.

(2) In the structure of connection between a coaxial cable and a shield terminal of (1), the crimp member has a seam orthogonal to a circumferential direction.

(3) In the structure of connection between a coaxial cable and a shield terminal of (1) or (2), the press bond part is formed in substantially a cylindrical shape without a seam.

(4) According to another aspect of the invention, a method of connection between a coaxial cable and a shield terminal, the method of making connection between the coaxial cable having a core wire part made of a conductor, an insulating coating part with which said core wire part is coated, a braided shield with which an outer peripheral surface of said insulating coating part is covered, and an insulating tube with which an outer peripheral surface of said braided shield is covered, and the shield terminal having a press bond part pressed and bonded to the outer peripheral surface of the braided shield. The method includes a press bond part insertion step of inserting the press bond part in a gap formed between an inner peripheral surface of an end of the insulating tube and the outer peripheral surface of the braided shield, and a press bond step of pressing and bonding the press bond part to the braided shield by pressing and bonding a ring-shaped crimp member arranged on an outer peripheral surface of the end of the insulating tube.

In the structure of connection between the coaxial cable and the shield terminal according to the configuration (1), the end of the insulating tube is configured to have the inside diameter larger than the outside diameter of the press bond part, and the crimp member is arranged on the end of the insulating tube, and the press bond part is inserted between the inner peripheral surface of the end and the outer peripheral surface of the braided shield and is pressed and bonded to the outer peripheral surface of the braided shield by pressing and bonding the crimp member, so that it is unnecessary to peel the insulating tube so as to expose the braided shield in the size according to the press bond part of the shield terminal, with the result that assembly work can be facilitated.

In the structure of connection between the coaxial cable and the shield terminal according to the configuration (2), the crimp member is configured to have the seam orthogonal to the circumferential direction, so that the crimp member can easily tighten the outer peripheral surface of the insulating tube.

In the structure of connection between the coaxial cable and the shield terminal according to the configuration (3), the press bond part is formed in substantially the cylindrical shape without the seam, so that it is unnecessary to do work of folding a press bond piece, with the result that assembly work is facilitated.

The method of connection between the coaxial cable and the shield terminal according to the configuration (4) includes the press bond part insertion step of inserting the press bond part between the inner peripheral surface of the end of the insulating tube and the outer peripheral surface of the braided shield, and the press bond step of pressing and bonding the press bond part to the braided shield by pressing and bonding the ring-shaped crimp member arranged on the outer peripheral surface of the end of the insulating tube, so that it is unnecessary to peel the insulating tube according to the size of the press bond part, with the result that assembly work can be facilitated.

DETAILED DESCRIPTION OF THE EXEMPLARY EMBODIMENTS

A preferred embodiment of a structure of connection between a coaxial cable and a shield terminal according to the invention and a method of connection therebetween will hereinafter be described in detail with reference to the drawings.

Embodiment

Figure 1:
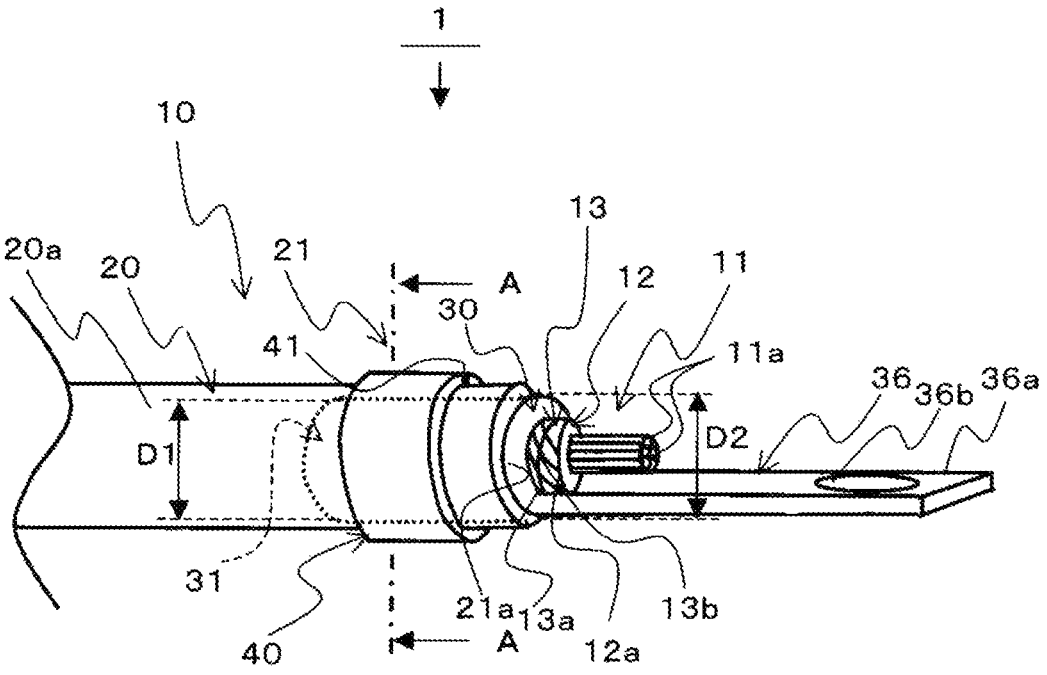
FIG. 1 is a perspective view showing a structure of connection between a coaxial cable and a shield terminal according to an embodiment of the invention.
Figure 2:
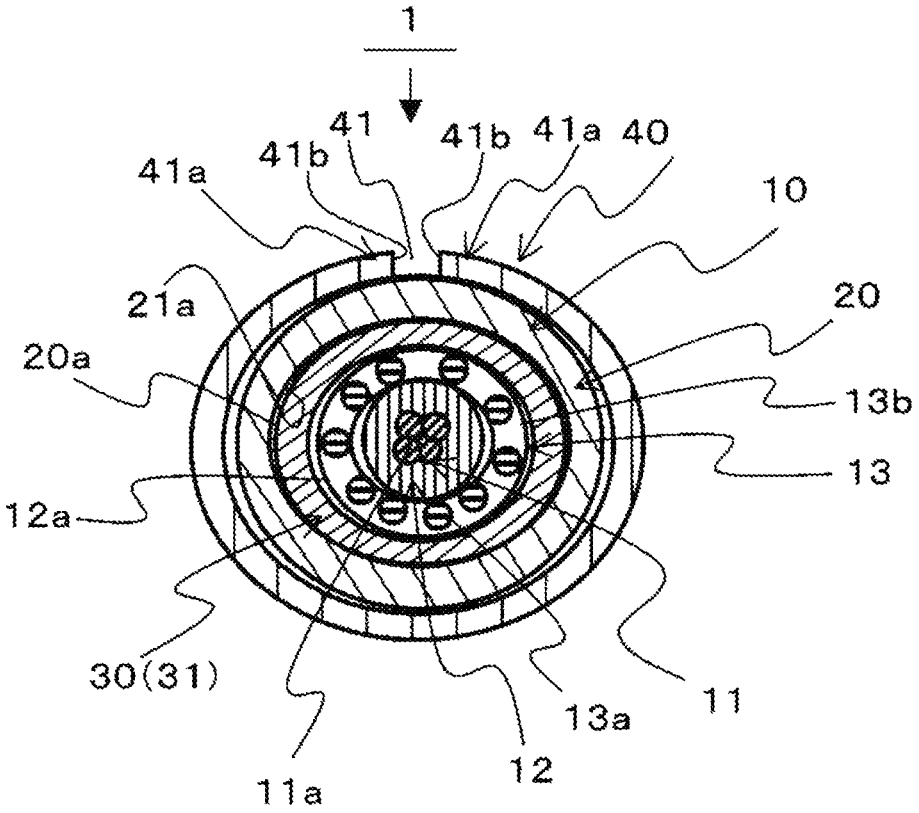
FIG. 2 is a sectional view taken on line A-A of the structure of connection between the coaxial cable and the shield terminal shown in FIG. 1.
Figure 3:
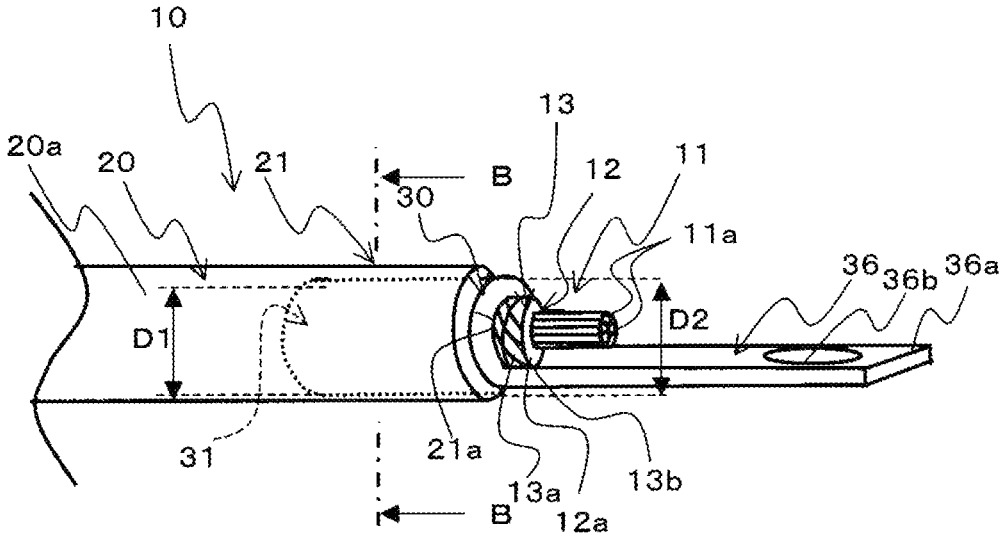
FIG. 3 is a perspective view showing the structure of connection between the coaxial cable and the shield terminal before a crimp member is attached.
Figure 4:
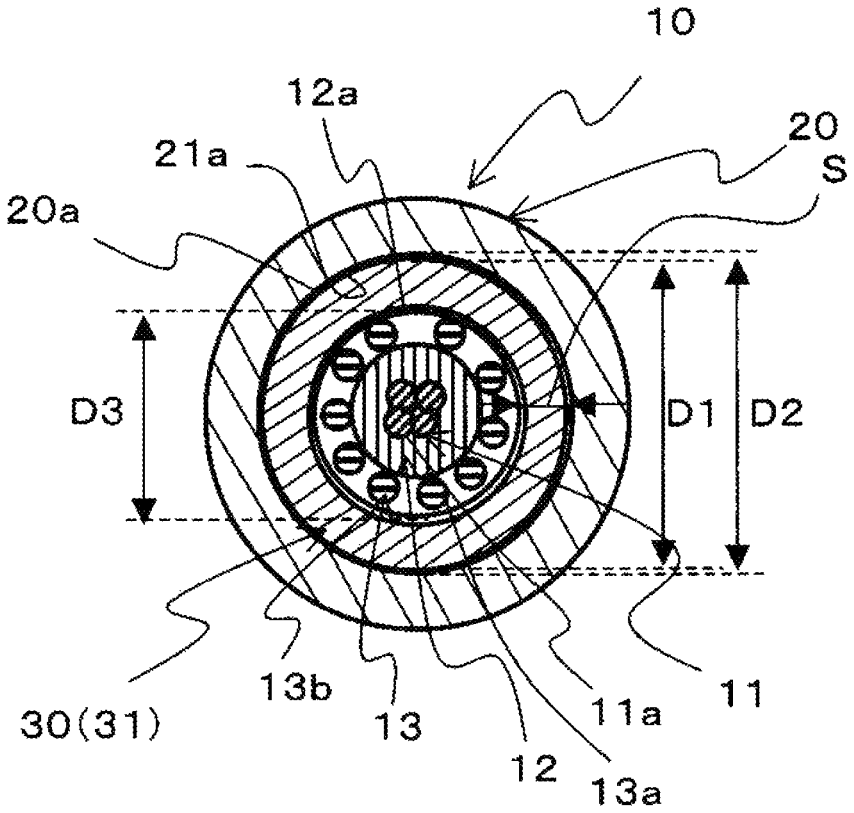
FIG. 4 is a sectional view taken on line B-B of the structure of connection between the coaxial cable and the shield terminal before the crimp member shown in FIG. 3 is attached.
Figure 5:
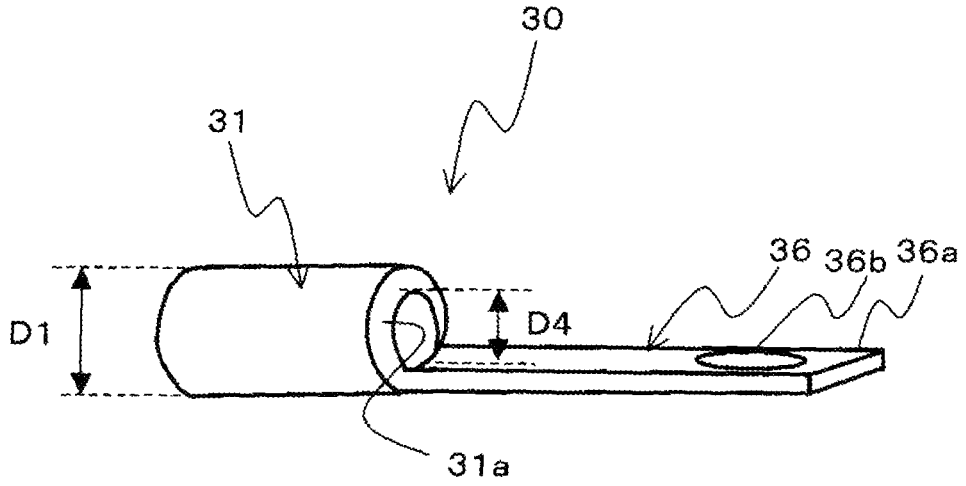
FIG. 5 is an enlarged perspective view of the shield terminal shown in FIG. 1.
Figure 6A:
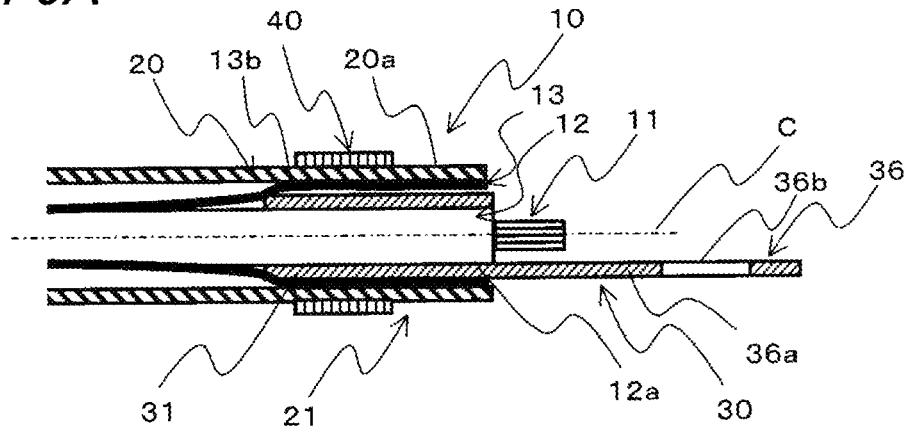
FIGS. 6A and 6B are explanatory diagrams of a positional relation between a press bond part and a braided shield and its effect.
Figure 6B:
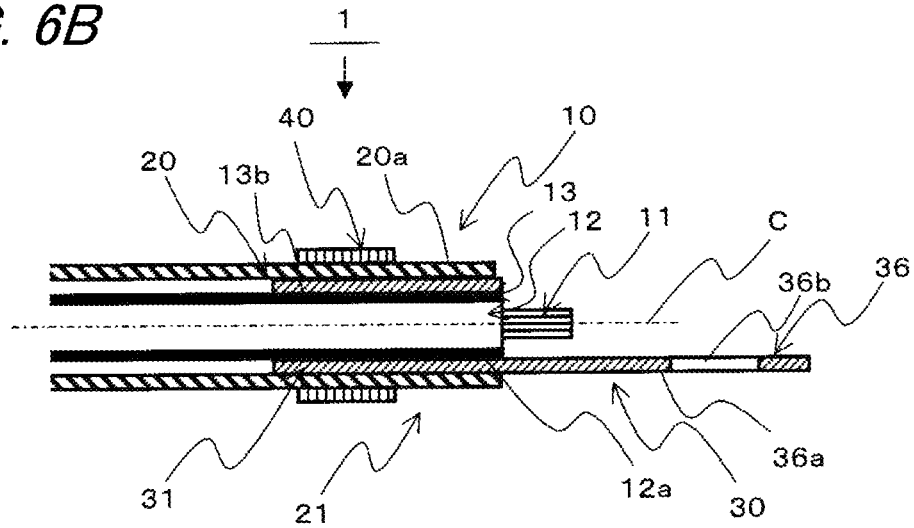

FIG. 1 is a perspective view showing a structure 1 of connection between a coaxial cable and a shield terminal according to an embodiment of the invention. FIG. 2 is a sectional view taken on line A-A of the structure 1 of connection between the coaxial cable and the shield terminal shown in FIG. 1. FIG. 3 is a perspective view showing the structure 1 of connection between the coaxial cable and the shield terminal before a crimp member 40 is attached. FIG. 4 is a sectional view taken on line B-B of the structure 1 of connection between the coaxial cable and the shield terminal before the crimp member 40 shown in FIG. 3 is attached. FIG. 5 is an enlarged perspective view of a shield terminal 30 shown in FIG. 1. FIGS. 6A and 6B are explanatory diagrams of a positional relation between a press bond part 31 and a braided shield 13 and its effect.

The structure 1 of connection between the coaxial cable and the shield terminal according to the embodiment of the invention is configured to have a coaxial cable 10 configured to have a core wire part 11 made of a conductor, an insulating coating part 12 with which the core wire part 11 is coated, the braided shield 13 with which an outer peripheral surface 12*a* of the insulating coating part 12 is covered, and an insulating tube 20 with which an outer peripheral surface 13*b* of the braided shield 13 is covered, the shield terminal 30 configured to have the cylindrical press bond part 31 pressed and bonded to the outer peripheral surface 13*b* of the braided shield 13, and the ring-shaped crimp member 40 pressed and bonded to an outer peripheral surface 20*a* of the insulating tube 20.

First, the coaxial cable 10 will be described.

The coaxial cable 10 is, for example, an electric wire for transmitting a high-frequency signal.

The core wire part 11 is formed by twisting plural core wires 11*b* made of the conductor such as copper alloy, and functions as a signal line for transmitting an electrical signal.

In addition, the core wire part 11 formed by twisting the plural core wires, but is not limited to this core wire part 11, and the plural core wires may be spaced in a diametrical direction without being twisted. Or, the core wire part 11 may be formed of one core wire.

The insulating coating part 12 is made of an insulating material such as synthetic resin, and the core wire part 11 is covered with the insulating coating part 12 so as to be able to insulate the core wire part 11.

The braided shield 13 is formed by knitting plural metal wires 13*a*, and functions as a shield layer for preventing electromagnetic noise from the outside from entering a signal transmitted through the core wire part 11 by covering the insulating coating part 12.

The insulating tube 20 is a tube made of an insulating material, and is configured to have an inside diameter D2 larger than an outside diameter D1 of the press bond part 31 as shown in FIG. 4. As a result, a gap S in which the press bond part 31 can be inserted between an inner peripheral surface 21*a* of an end 21 of the insulating tube 20 and the outer peripheral surface 13*b* of the braided shield 13 is formed.

In addition, the inside diameter D2 of the insulating tube 20 is preferably set in the size in which only the amount of thickness of the press bond part 31 is added to an outside diameter D3 of the braided shield 13 with which the outer peripheral surface 12*a* of the insulating coating part 12 is covered.

Next, the shield terminal 30 will be described.

The shield terminal 30 is a terminal for making earth connection between the braided shield 13 and an earth part (not shown) by being electrically connected to the braided shield 13. This shield terminal 30 is configured to have the press bond part 31 pressed and bonded to the outer peripheral surface 13*b* of the braided shield 13, and a connection part 36 connected to an electric wire etc. (not shown) connected to the earth part.

As shown in FIG. 5, the press bond part 31 is formed in substantially a cylindrical shape without a seam along a circumferential direction, and is configured to be formed so that an inside diameter D4 becomes larger than the outside diameter D3 of the braided shield 13 with which the outer peripheral surface 12*a* of the insulating coating part 12 is covered.

The connection part 36 is configured to have a plate-shaped part 36*a* projected to an edge surface 31*a* of the press bond part 31, and a through hole part 36*b* which is a through hole of the plate-shaped part 36*a*. The shield terminal 30 is constructed so as to make earth connection through an earth electric wire (not shown) by connecting the earth electric wire through this through hole part 36*b*.

In addition, the connection part 36 configured to have the plate-shaped part 36*a* and the through hole part 36*b* is illustrated, but is not limited to this connection part 36. That is, as long as the earth connection can be made, other shapes may be used. For example, a configuration like the so-called press contact terminal configured to have a press contact piece may be used.

Then, the crimp member 40 will be described.

The crimp member 40 is a ring-shaped member made of a metal material etc. This crimp member 40 is configured to have a seam 41 orthogonal to a circumferential direction, and this seam 41 is constructed so as to form a predetermined gap. It becomes easy to adjust an inside diameter of the crimp member 40 by such a seam 41. That is, the crimp member 40 is constructed so as to be easy to tighten the outer peripheral surface 20*a* of the insulating tube 20.

In the structure 1 of connection between the coaxial cable and the shield terminal as described above, the press bond part 31 can be inserted between the inner peripheral surface 21*a* of the end 21 of the insulating tube 20 and the outer peripheral surface 13*b* of the braided shield 13, so that it is unnecessary to peel the insulating tube 20 so as to expose the braided shield 13 in the size according to the press bond part 31 of the shield terminal 30.

Moreover, since the press bond part 31 is pressed and bonded to the outer peripheral surface 13*b* of the braided shield 13 as shown in FIG. 6B, the braided shield 13 and the press bond part 31 are arranged in substantially parallel with an axis line C as compared with the case of pressing and bonding the braided shield 13 to the inside of the braided shield 13 as shown in FIG. 6A. As a result, the press bond part 31 can be pressed and bonded to the braided shield 13 in the natural form of the press bond part 31 and the braided shield 13, and a shearing force can be prevented from acting on the braided shield 13 by the edge of the press bond part 31.

Here, a method of connection between the coaxial cable 10 and the shield terminal 30 will be described using FIGS. 7A to 7D. FIGS. 7A to 7D show steps of making connection between the coaxial cable 10 and the shield terminal 30.

Figure 7A:
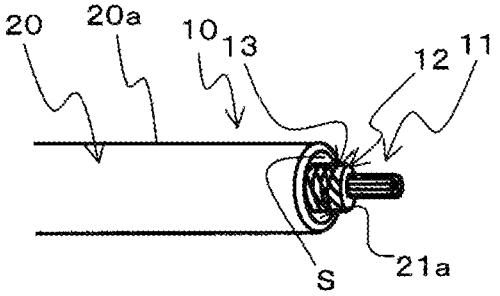
FIGS. 7A to 7D show steps of making connection between the coaxial cable and the shield terminal.

First, a worker peels the end 21 of the insulating tube 20 so as to expose an end 11*a* of the core wire part 11 (FIG. 7A). Since the press bond part 31 can be inserted between the inner peripheral surface 21*a* of the insulating tube 20 and the outer peripheral surface 13*b* of the braided shield 13, it is unnecessary to peel the insulating tube 20 according to the size of the press bond part 31.

Figure 7B:
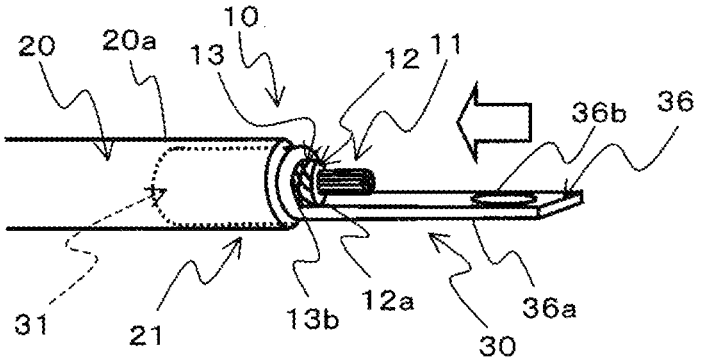

Subsequently, the worker inserts the press bond part 31 between the inner peripheral surface 21*a* of the insulating tube 20 and the outer peripheral surface 13*b* of the braided shield 13 (FIG. 7B). In the case of inserting this press bond part 31, the gap S in which the press bond part 31 can be inserted between the inner peripheral surface 21*a* of the insulating tube 20 and the outer peripheral surface 13*b* of the braided shield 13 is formed, so that the press bond part 31 can be inserted easily. As a result, it is unnecessary to expose the braided shield 13 according to the size of the press bond part 31.

Figure 7C:
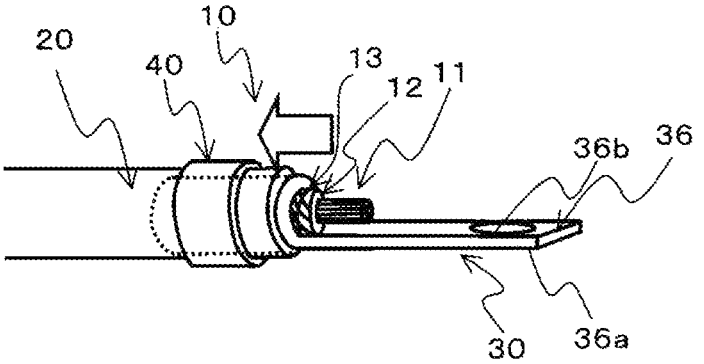

Subsequently, the worker inserts the outer peripheral surface 20*a* of the insulating tube 20 into the crimp member 40 (FIG. 7C). In this case, the crimp member 40 is arranged on the end 21 of the insulating tube 20.

Figure 7D:
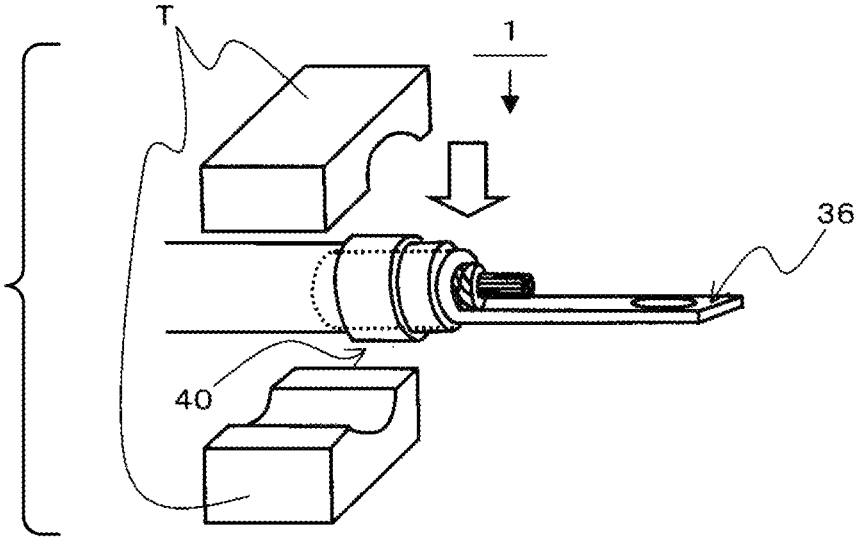

Subsequently, the worker crimps the crimp member 40 using a jig T for crimping (FIG. 7D). Consequently, the press bond part 31 is pressed and bonded to the outer peripheral surface 13*b* of the braided shield 13 to complete the connection between the coaxial cable 10 and the shield terminal 30.

In the structure 1 of connection between the coaxial cable and the shield terminal according to the embodiment of the invention, the end 21 of the insulating tube 20 is configured to have the inside diameter D2 larger than the outside diameter D1 of the press bond part 31, and the crimp member 40 is arranged on the end 21 of the insulating tube 20, and the press bond part 31 is inserted between the inner peripheral surface 21*a* of the end 21 and the outer peripheral surface 13*b* of the braided shield 13 and is pressed and bonded to the outer peripheral surface 13*b* of the braided shield 13 by pressing and bonding the crimp member 40, so that it is unnecessary to peel the insulating tube 20 so as to expose the braided shield 13 in the size according to the press bond part 31 of the shield terminal 30, with the result that assembly work can be facilitated.

Also, in the structure 1 of connection between the coaxial cable and the shield terminal according to the embodiment of the invention, the press bond part 31 is pressed and bonded to the braided shield 13 in the natural form of the press bond part 31 and the braided shield 13 by pressing and bonding the press bond part 31 to the outer peripheral surface 13*b* of the braided shield 13, so that the shearing force can be prevented from acting on the braided shield 13 by the edge of the press bond part 31. Consequently, the press bond part 31 can be prevented from damaging the braided shield 13.

Also, in the structure 1 of connection between the coaxial cable and the shield terminal according to the embodiment of the invention, the crimp member 40 is configured to have the seam 41 orthogonal to the circumferential direction, so that the crimp member 40 can easily tighten the outer peripheral surface 20*a* of the insulating tube 20.

Also, in the structure 1 of connection between the coaxial cable and the shield terminal according to the embodiment of the invention, the press bond part 31 is formed in substantially the cylindrical shape without the seam, so that it is unnecessary to do work of folding a press bond piece, with the result that assembly work is facilitated.

Also, the method of connection between the coaxial cable and the shield terminal according to the embodiment of the invention includes a press bond part insertion step of inserting the press bond part 31 between the inner peripheral surface 21*a* of the end 21 of the insulating tube 20 and the outer peripheral surface 13*b* of the braided shield 13, and a press bond step of pressing and bonding the press bond part 31 to the braided shield 13 by pressing and bonding the ring-shaped crimp member 40 arranged on the outer peripheral surface 20*a* of the end 21 of the insulating tube 20, so that the insulating tube 20 can be peeled regardless of the size of the press bond part 31, with the result that assembly work can be facilitated.

Modified Example 1

Figure 8:
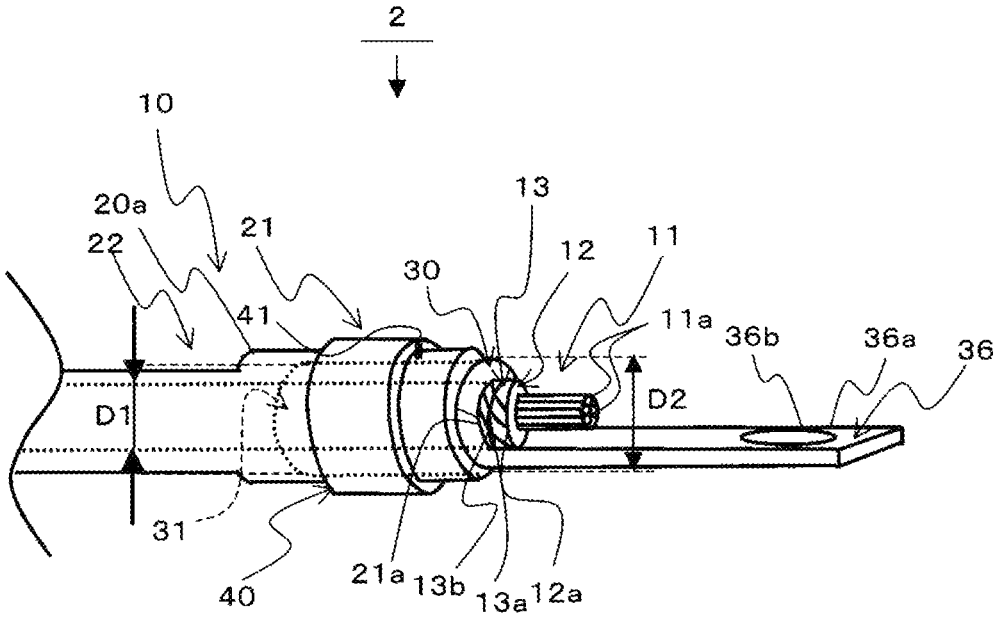
FIG. 8 is a perspective view showing a structure of connection between a coaxial cable and a shield terminal of a modified example 1.

Next, a modified example 1 of the structure 1 of connection between the coaxial cable and the shield terminal according to the embodiment of the invention will be described using FIG. 8. FIG. 8 is a perspective view showing a structure 2 of connection between a coaxial cable and a shield terminal of the modified example 1.

The structure 2 of connection between the coaxial cable and the shield terminal of this modified example 1 differs from the structure 1 of connection between the coaxial cable and the shield terminal of the embodiment in that the structure 2 is configured to have an insulating tube 22 instead of the insulating tube 20.

In addition, the other configuration is similar to that of the embodiment, and the same numerals are assigned to the same components as those of the embodiment.

Except for an end 21 of the insulating tube 22, an inside diameter D2 is set smaller than the end 21 so as to cover a braided shield 13 without any gap.

The structure 2 of connection between the coaxial cable and the shield terminal of this modified example 1 can have an effect similar to that of the structure 1 of connection between the coaxial cable and the shield terminal of the embodiment and also, an outside diameter other than the end 21 in the insulating tube 22 can be set small.

Modified Example 2

Figure 9:
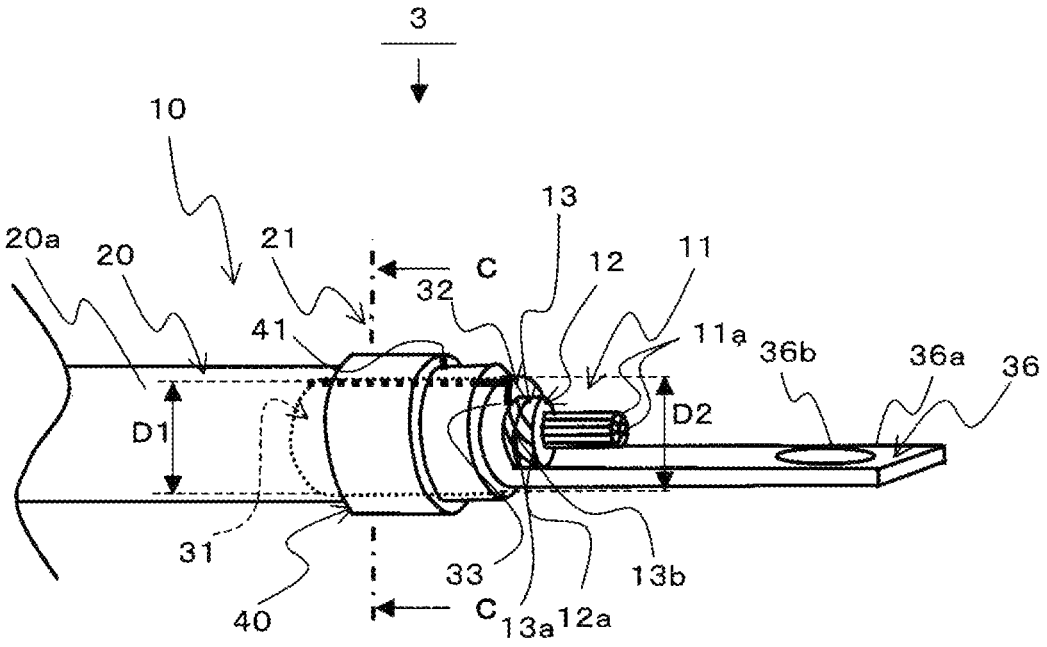
FIG. 9 is a perspective view showing a structure of connection between a coaxial cable and a shield terminal of a modified example 2.
Figure 10:
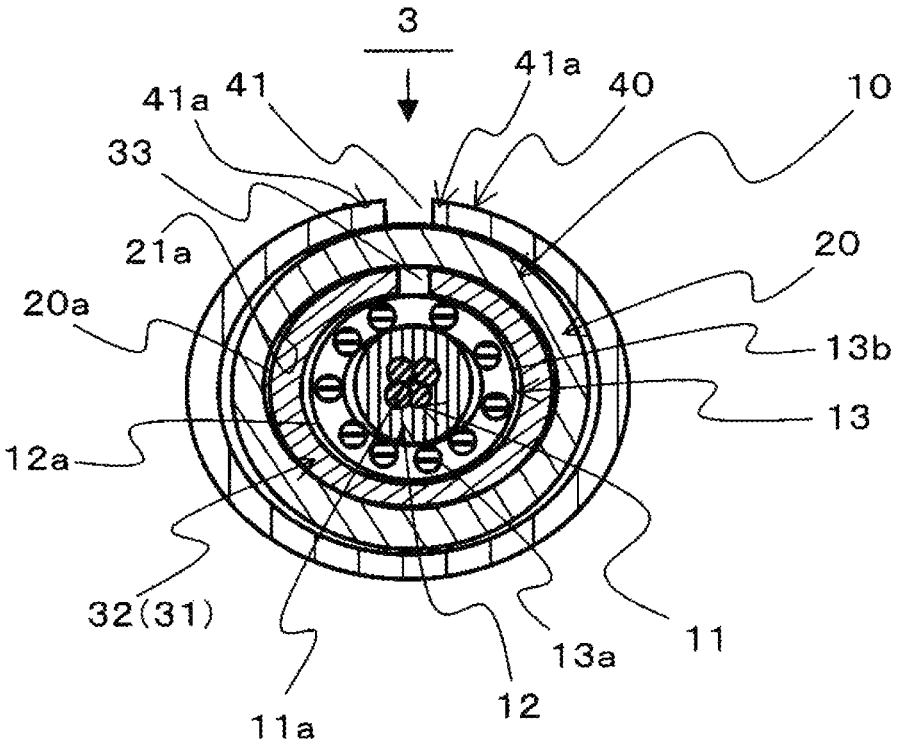
FIG. 10 is a sectional view taken on line C-C of the structure of connection between the coaxial cable and the shield terminal shown in FIG. 9.

Next, a modified example 2 of the structure 1 of connection between the coaxial cable and the shield terminal according to the embodiment of the invention will be described using FIGS. 9 and 10. FIG. 9 is a perspective view showing a structure 3 of connection between a coaxial cable and a shield terminal of the modified example 2. FIG. 10 is a sectional view taken on line C-C of the structure 3 of connection between the coaxial cable and the shield terminal shown in FIG. 9.

The structure 3 of connection between the coaxial cable and the shield terminal of this modified example 2 differs from the structure 1 of connection between the coaxial cable and the shield terminal of the embodiment in that the structure 3 is configured to have a shield terminal 32 instead of the shield terminal 30.

In addition, the other configuration is similar to that of the embodiment, and the same numerals are assigned to the same components as those of the embodiment.

A press bond part 31 of the shield terminal 32 is configured to have a seam part 33 orthogonal to a circumferential direction. As a result, it becomes easy to adjust an inside diameter of the press bond part 31. That is, the press bond part 31 is constructed so as to be easy to be pressed and bonded to an outer peripheral surface 13*b* of a braided shield 13.

The structure 3 of connection between the coaxial cable and the shield terminal of this modified example 2 can have an effect similar to that of the structure 1 of connection between the coaxial cable and the shield terminal of the embodiment.

Moreover, the press bond part 31 is configured to have the seam part 33, so that the press bond part 31 is constructed so as to be easy to be brought into closer contact with the braided shield 13.

Modified Example 3

Figure 11:
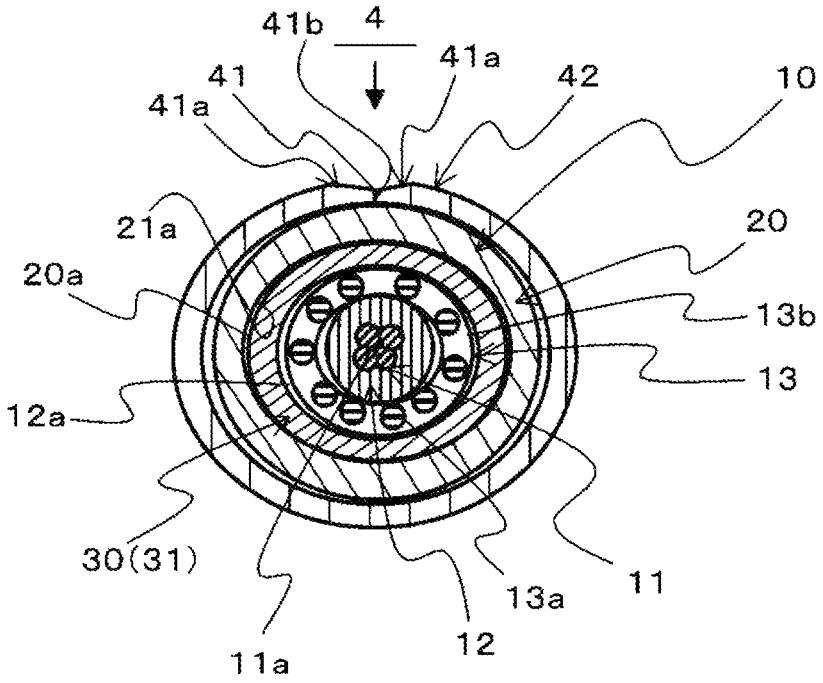
FIG. 11 is a main sectional view of a structure of connection between a coaxial cable and a shield terminal of a modified example 3.

Next, a modified example 3 of the structure 1 of connection between the coaxial cable and the shield terminal according to the embodiment of the invention will be described using FIG. 11. FIG. 11 is a main sectional view of a structure 4 of connection between a coaxial cable and a shield terminal of the modified example 3.

The structure 4 of connection between the coaxial cable and the shield terminal of this modified example 3 differs from the structure 1 of connection between the coaxial cable and the shield terminal of the embodiment in that the structure 4 is configured to have a crimp member 42 instead of the crimp member 40.

In addition, the other configuration is similar to that of the embodiment, and the same numerals are assigned to the same components as those of the embodiment.

The crimp member 42 is constructed so that edge surfaces 41*b*, 41*b* of both ends 41*a*, 41*a* forming a seam 41 abut. As a result, it becomes easy for both ends 41*a*, 41*a* of the crimp member 42 to bite into an outer peripheral surface 20*a* of an insulating tube 20 by crimping the crimp member 42.

The structure 4 of connection between the coaxial cable and the shield terminal of this modified example 3 can have an effect similar to that of the structure 1 of connection between the coaxial cable and the shield terminal of the embodiment.

Also, the crimp member 42 can strongly be fixed to the insulating tube 20.

Modified Example 4

Figure 12:
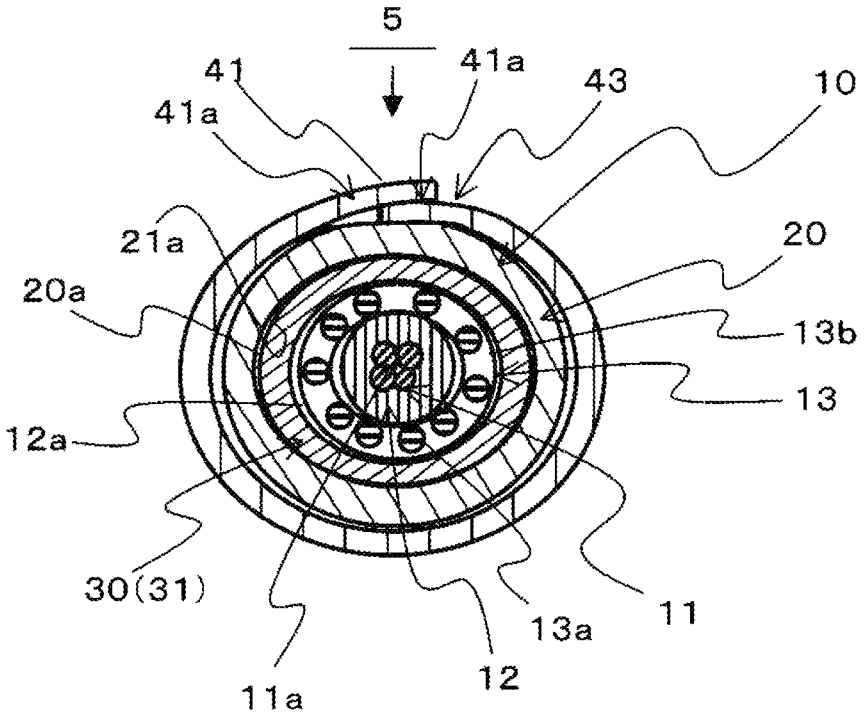
FIG. 12 is a main sectional view of a structure of connection between a coaxial cable and a shield terminal of a modified example 4.

Next, a modified example 4 of the structure 1 of connection between the coaxial cable and the shield terminal according to the embodiment of the invention will be described using FIG. 12. FIG. 12 is a main sectional view of a structure 5 of connection between a coaxial cable and a shield terminal of the modified example 4.

The structure 5 of connection between the coaxial cable and the shield terminal of this modified example 4 differs from the structure 1 of connection between the coaxial cable and the shield terminal of the embodiment in that the structure 5 is configured to have a crimp member 43 instead of the crimp member 40.

In addition, the other configuration is similar to that of the embodiment, and the same numerals are assigned to the same components as those of the embodiment.

The crimp member 43 is constructed so that both ends 41*a*, 41*a* overlap. As a result, the crimp member 43 is constructed so as to surely cover an outer peripheral surface 20*a* of an insulating tube 20 in an outer peripheral direction of the insulating tube 20.

The structure 5 of connection between the coaxial cable and the shield terminal of this modified example 4 can have an effect similar to that of the structure 1 of connection between the coaxial cable and the shield terminal of the embodiment.

Also, the outer peripheral surface 20*a* of the insulating tube 20 can surely be crimped in the outer peripheral direction of the insulating tube 20.

In addition, the structures 1, 2, 3, 4, 5 of connection between the coaxial cable and the shield terminal according to the embodiment of the invention illustrate the crimp member 40 configured to have the seam 41, but a crimp member without the seam 41 may be used.

The invention implemented by the present inventor has concretely been described above based on the embodiments of the invention described above, but the invention is not limited to the embodiments of the invention described above, and various changes can be made without departing from the gist of the invention.

The present invention is useful for providing a structure of connection between a coaxial cable and a shield terminal capable of facilitating assembly work, and a method of connection therebetween.

What is claimed is:

1. A structure of connection between a coaxial cable and a shield terminal comprising:

the coaxial cable configured to have at least one core wire part made of a conductor, an insulating coating part with which said core wire part is coated, a braided shield with which an outer peripheral surface of said insulating coating part is covered, and an insulating tube with which an outer peripheral surface of said braided shield is covered;

the shield terminal that has a cylindrical press bond part pressed and is bonded to the outer peripheral surface of the braided shield; and a ring-shaped crimp member that is pressed and bonded to an outer peripheral surface of the insulating tube, wherein at least an end of the insulating tube is configured to form a gap between the braided shield and have an inside diameter larger than an outside diameter of the press bond part, the crimp member is arranged on the end of the insulating tube, and the press bond part is inserted between an inner peripheral surface of the end of the insulating tube and the outer peripheral surface of the braided shield and is pressed and bonded to the outer peripheral surface of the braided shield by pressing and bonding the crimp member.

2. A structure of connection between a coaxial cable and a shield terminal as claimed in claim 1, wherein the crimp member has a seam orthogonal to a circumferential direction.

3. A structure of connection between a coaxial cable and a shield terminal as claimed in claim 1, wherein the press bond part is formed in substantially a cylindrical shape without a seam.

* * * * *